US005885035A

United States Patent [19]

Hoffschneider

[11] Patent Number: 5,885,035

[45] Date of Patent: Mar. 23, 1999

[54] TROWEL FILER

[75] Inventor: Fredrick H. Hoffschneider, Cape Fair, Mo.

[73] Assignee: MTF, Inc., Cape Fair, Mo.

[21] Appl. No.: 778,767

[22] Filed: Jan. 6, 1997

Related U.S. Application Data

[60] Provisional application No. 60/012,812 Mar. 4, 1996.

[51] Int. Cl.[6] ..... B24D 15/02

[52] U.S. Cl. ..... 407/29.15; 407/29.11; 76/83

[58] Field of Search ..... 407/29.15, 29.11, 407/29.14; 76/83, 88, 82

[56] References Cited

U.S. PATENT DOCUMENTS

| | | | |
|---|---|---|---|
| D. 310,162 | 8/1990 | DeJohn | D8/90 |
| 512,382 | 1/1894 | Knowles et al. | 76/83 |
| 527,350 | 10/1894 | Taylor | 76/83 |
| 1,594,246 | 5/1926 | Dechert | 76/83 |
| 2,871,729 | 2/1959 | Schoonover | 76/82 |
| 3,714,743 | 2/1973 | Hall | 51/392 |
| 3,871,141 | 3/1975 | Bonapace | 51/358 |
| 3,914,839 | 10/1975 | Holdsworth | 407/29.15 |
| 4,137,670 | 2/1979 | Goralski | 51/392 |
| 5,383,307 | 1/1995 | Anderson | 451/545 |

*Primary Examiner*—Frances Han
*Assistant Examiner*—Mark Williams
*Attorney, Agent, or Firm*—Jonathan A. Bay

[57] ABSTRACT

A filing tool for filing trowel edges includes a metal file and a body to contain and hold the file in a securely clamped arrangement. The body forms a relatively narrow guide slot which is given generally parallel side walls as well as a generally open bottom, front and back. The file's filing surface forms the upper boundary of the slot. The slot is given a gap that allows close fitting passage of blade of a trowel. The filing tool is used for dulling and straightening the sharp and worn edges that appear on the blade of a finishing trowel and are caused by use of the trowel while spreading, shaping and/or leveling abrasive viscous material such as cement, mortar, or grout and the like.

13 Claims, 6 Drawing Sheets

TROWEL FILER

CROSS-REFERENCE TO PROVISIONAL APPLICATION

This application claims the benefit of U.S. Provisional Application No. 60/012,812, filed Mar. 4, 1996.

BACKGROUND OF THE INVENTION

The invention relates to a filing tool for filing trowel edges, and more particularly concerns a hand-held filing tool for dulling and straightening the sharp and worn edges that appear on the blade of a finishing trowel. These sharp edges are caused by use of the trowel while spreading, shaping and/or leveling abrasive viscous material such as cement, mortar, or grout and the like as typically used by various trades such as cement finishers, brick layers, masons, plasterers, sheet-rockers, stucco finishers, floor-tile layers and so on.

SUMMARY OF THE INVENTION

It is an object of the invention to provide a filing tool for filing the worn edges of a trowel in which, a metal file inside a body of the tool is securely clamped and held to prevent relative movement between the file and the tool's body during use.

It is another object to construct the above tool body via an assembly of a web component and left and right flange components depending from the relatively upper web component, wherein the file is clamped between the web and flange components.

It is yet another object of the invention to minimize the spacing between the file's filing surface and the web component's top wall in order to improve handling stability of the filing tool. One way to achieve this is to rest the file in a recess in the web component such that only the top wall's effective "skin thickness" covers the file.

These and other aspects and objects are provided according to the invention in a handtool for filing worn edges of a trowel blade. The handtool includes a metal file and a body assembly designed to encase and contain the file.

The body assembly preferably has an elongated web component and left and right elongated flange components assembled to depend or hang down from the relatively upper web component. The reference directions of up and down, as well as left, right, front and back are used merely for convenience in this description, and are taken from vantage point of a user holding the handtool as shown by FIG. 5, but do not limit the invention to a particular orientation or use or otherwise.

The left and right flange components define a relatively narrow guide slot between each other. The guide slot has generally parallel side walls in the left and right flange components. The guide slot is also given a generally open bottom, front and back boundary. The guide slot is additionally given a width adapted for allowing close fitting passage of a blade of a trowel through it.

The web and flange components are preferably made from moldable polymer or resinous materials for economy and simplicity. The web and flange components are preferably interconnected by means of fasteners, likewise for economy and simplicity. However, other interconnecting arrangements are possible and suitable including without limitation adhesives and so on.

Between (i) the web component and/or (ii) the left and right flange components in combination, one of those is chosen for being formed with a recess in which the flat file can rest. The recess is shaped to closely surround the file to restrain side to side movement as well as rolling and/or pitching. The recess is positioned such that one of the file's filing surfaces forms the upper boundary of the guide slot.

The other of (i) the web component and/or (ii) the left and right flange components in combination (i.e., the one which does not include the recess), is chosen for being formed with abutment surfaces to abut the file while at rest in the recess for it. Given the foregoing, tightening the fasteners effectively creates a clamping arrangement on the file between the web and flange components, and therefore effectively clamps the file effectively immobile relative to the body assembly as whole.

It is preferred if the file-encasing recess is formed in the web component rather than the flange components. That way, the distance between the top wall of the web component and file's filing surface can be kept to a minimum, or at least minimized to whatever minimum skin thickness of material will suffice in forming the top wall over the file. In different words, the web component has a top wall, and a spaced bottom preferably in which the recess is formed. The recess is configured to extend into the web component all the way to the top wall such that distance between the top wall and the filing surface of file at rest in the recess, is minimized as much possible. Arranging the file like that in the body assembly assists the handling stability of the handtool.

However, one of the inventive aspects of the filing tool disclosed and claimed herein is the clamping arrangement on the file between the web and flange components. Therefore, it is contemplated that a substantially literal variation of forming the recess in the web component is, to form it in the flange components instead.

It is also preferred if the top wall of the web component is formed with either a forefinger guide or a handle and the like to give a user a more comfortable handgrip. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE INVENTION

Figure 1:
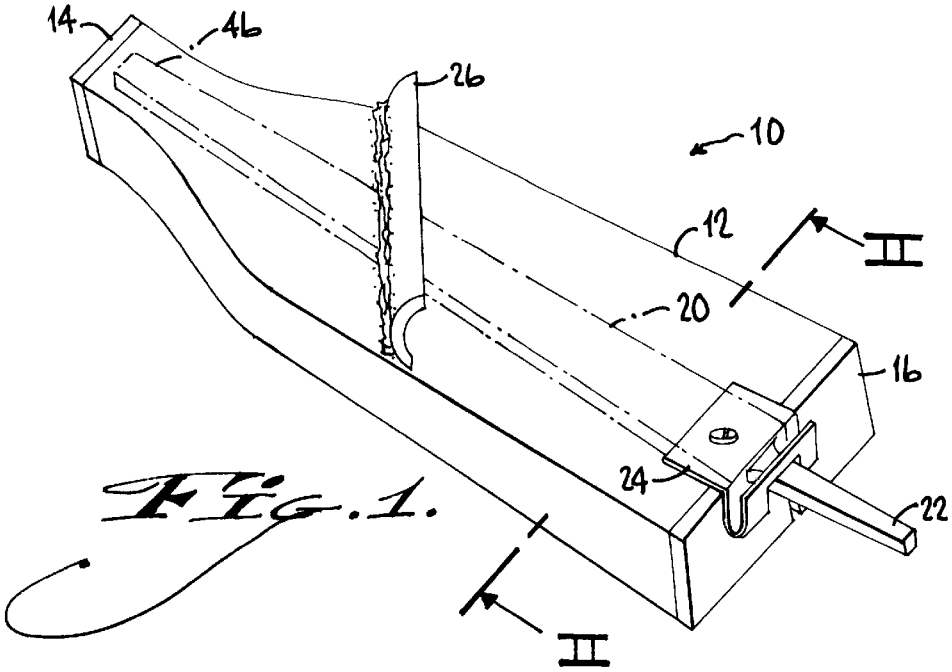
FIG. 1 is a top perspective view of a filing tool in accordance with the invention, for filing trowel edges.

FIG. 1 shows a filing tool 10 in accordance with the invention for filing the worn edges of a cement-finishing trowel (not shown in FIG. 1). The filing tool 10 comprises a substantially hollow body 12 extending between spaced front and rear end caps 14 and 16. Enclosed within the hollow body 12 there extends a flat metal-file 20 (substantially shown in broken lines) with its long axis aligned with the long axis of the tool body 12. The flat file 20 has a tail end 22 protruding rearwardly beyond the rear end cap 16. The tail end 22 is engaged by a retaining clip 24 that is attached to the tool body 12 by a screw. The retaining clip 24 acts to keep the fiat file 20 temporarily locked in position and opposes rearward axial movement of the file 20 during use.

The tool body 12 has a forefinger guide 26 attached to it a little forward of midway between the front and rear end caps 14 and 16. The forefinger guide 26 can be formed, for example, from a cylindrical tube split apart in halves down the central axis thereof. The tool body 12 and forefinger guide 26 can be fabricated from steel or aluminum and the like, and then can be affixed together by welding or brazing or like processes. It would be preferable for other reasons, however, if the tool body 12 and forefinger guide 26 were molded from a polymer or resinous material. One reason to favor a polymer or resinous material would be, for example, to exploit use of more economical materials for manufacture of the filing tool 10. The forefinger guide 26 is, as shown, oriented on the tool body 12 at about a 45° angle to the long axis of the tool body 12. While the forefinger guide 26 is angled for a right-landed user, simple inversion of the angle would make the forefinger guide 26 oriented for a left-handed user.

Figure 2:
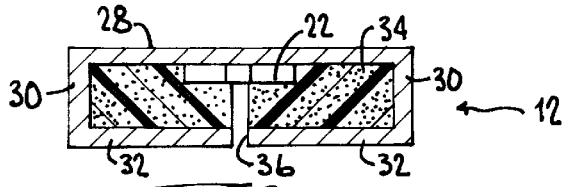
FIG. 2 is a partial sectional view thereof taken through line II—II in FIG. 1.

FIG. 2 is a partial sectional view of the filing tool 10 in FIG. 1, as taken through line II—II in FIG. 1. As FIG. 2 shows, the hollow body 12 defines a rectangular tubular shape. It has a top wall 28, a pair of spaced side walls 30, and a split bottom wall 32. The tubular body 12 defines a generally rectangular interior which is substantially occupied by a filler material 34 such as, for example, hard rubber, neoprene, or any other suitable polymer or resinous material that is deformable to some extent, but yet relatively difficult to deform under a merely moderate pressure. The stiffness of the filler material 34 is chosen primarily for purposes of retaining the flat file 20 in position and opposing lateral and up-and-down (up-and-down relative to FIG. 2) movement of the file 20.

Figure 3:
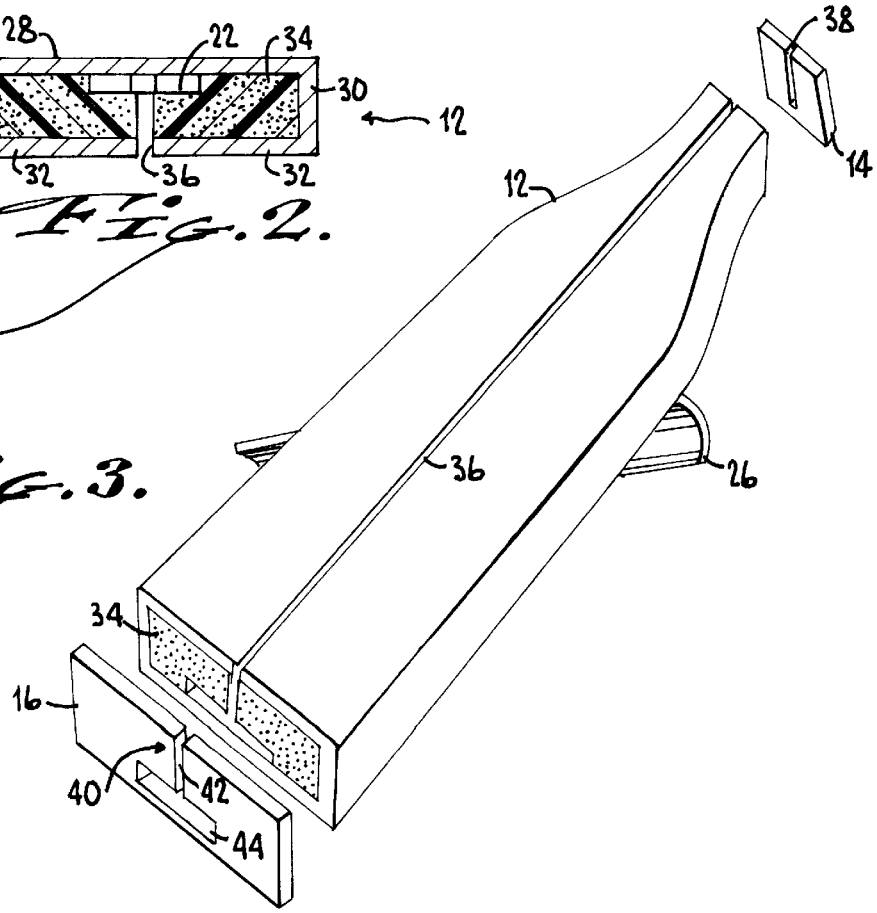
FIG. 3 is an exploded bottom view of FIG. 1.

With reference to FIG. 3, the split bottom wall 32 is partitioned for its entire axial length by a through slot 36 (which, further below, is referred to as "guide slot"). The front end cap 14 is formed with a like slot 38 that aligns with the through slot 36 of the bottom wall 32 when attached. The rear end cap 16 is formed with an inverted-T shaped slot 40 (inverted from the vantage point of FIG. 3). The inverted-T shaped slot 40 comprises a vertical stem-segment 42 intersecting a horizontal cross-segment 44. In this description, terms and phraseology such as "up" and "down", "front" and "rear," and "vertical" and "horizontal" and the like are used merely for convenience for reference purposes to the drawings and do not limit the invention to a given orientation or arrangement.

The horizontal cross-segment 44 is shaped and arranged to allow removable insertion of the flat file 20 in and out of the tool body 12. The flat file 20 is preferably used until one side is unusable because too loaded or dulled, after which the file 20 is turned a half-turn to use the opposite side thereof until it too becomes too worn, and following that the file 20 is eventually discarded and replaced with a fresh file. The filing tool 10 in accordance with the invention is sized and configured to hold a standard eight-inch file (30 cm). In use, the file 20 is restrained from forward axial displacement by its nose end 46 abutting the front end cap 14 (see, e.g., FIG. 1). Rearward axial displacement, as previously said, is prevented by the retaining clip 24. Additionally, as shown by FIG. 2, displacement of the file 20 in other directions—i.e., rolling, pitching and yawing as well as lateral or side-to-side displacement—is prevented by the file 20 being resiliently gripped between the filler material 34 and the top wall 28 of the tubular body 12.

FIG. 2 also gives a view of a typical profile of the guide slot 36. The guide slot 36 extends between open front and rear ends by virtue of the co-alignment of the front-end cap slot and rear-end cap slot-segment, 38 and 42 respectively (see FIG. 3). The filler material 34 is correspondingly partitioned in two to define the left and right side walls of the guide slot 36 (left and right relative to FIG. 2). The flat file 20 is exposed along an elongated strip down in its midline to define a top wall of the guide slot 36. This top wall of the guide slot is actually a portion of the raspy surface of the flat file 20 itself. As shown in FIG. 2, the filler material 34 is affixed in place by being bonded to the side and bottom walls 30 and 32 of the tubular body 12, and portions of the top wall 28. When the retaining clip 24 (FIG. 1) is removed, the flat file 20 can be withdrawn from the tool body 12 if given a sufficient pull on its tail end 22. However, apart from that, the flat file 20 is relatively immovable in its squeezed-in envelope of filler material 34.

Figure 4:
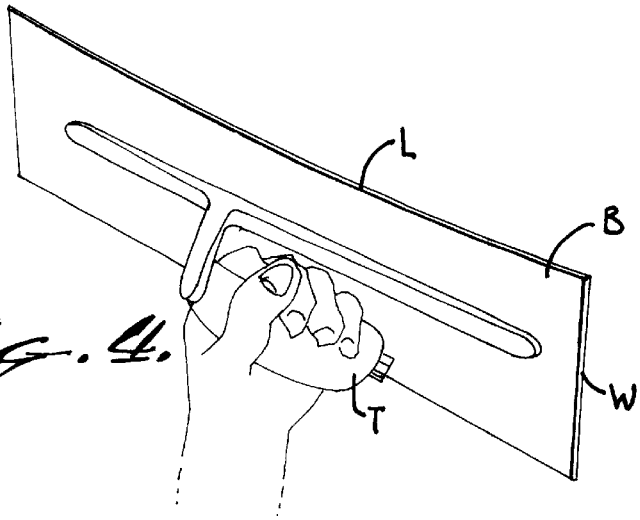
FIG. 4 is a perspective view of a prior art cement-finishing trowel that has worn edges that are both too sharp and uneven.

FIG. 4 shows a prior art finishing trowel T. This trowel T is representative, without limitation, of the trowels used by various trades, such as cement finishers, brick layers, masons, plasterers, sheet-rockers, floor-tile layers, and stucco finishers and so on, who use the trowel T to spread, shape and/or level cement, mortar and grout or the like. Whereas in this description the use of the filing tool 10 is given with reference to a mason who finishes cement, the particular reference to a mason and the job of cement-finishing is given for convenience only and does not limit the usefulness of the invention to a single trade only. Indeed, the invention is especially useful to sheet-rockers who frequently stub and nick their trowels on the heads of screws used to fasten the sheetrock to stud frames. These nicks in the trowel require repair before the sheet-rockers or plasterers can give the mortar a proper finish.

To return to FIG. 4, the trowel T has a planar blade B extending width-wise between opposite long edges L and lengthwise between opposite short edges W. In use, the long edges L commonly wear down while a mason manipulates the trowel T to spread, shape and/or level cement. By wearing down, what commonly occurs more particularly, is that the long edges L are gradually ground down by abrasive particles within the cement until polished and honed to a sharp edge. A sharp edge is undesirable for several reasons. For one reason, a sharp edge hinders a mason from being able to give the cement a good finish. For another, a sharp edge is unsafe to the mason because the sharp edges easily get sharp enough to cause unintentional self-inflicted wounds if the trowel T is only slightly mishandled. Given the problems associated with sharp edges, masons have a frequent need to file down worn edges.

What masons typically have done in the past is to simply hold a flat file in their bare hand (not shown). There have been many problems associated with holding a flat file in the bare hand. First, results are best if the flat file is aligned straight with the length-wise extension of the trowel long edge. But the file has to be held carefully like that during filing strokes on the fulcrum of the sharp edge because, needless to say, the file is hard to balance and unstable in the hand like that. It is a dangerous mishap if the file should tilt and slip off the sharp edge because, as does happen, the mason's hand always gets severely cut.

Figure 5:
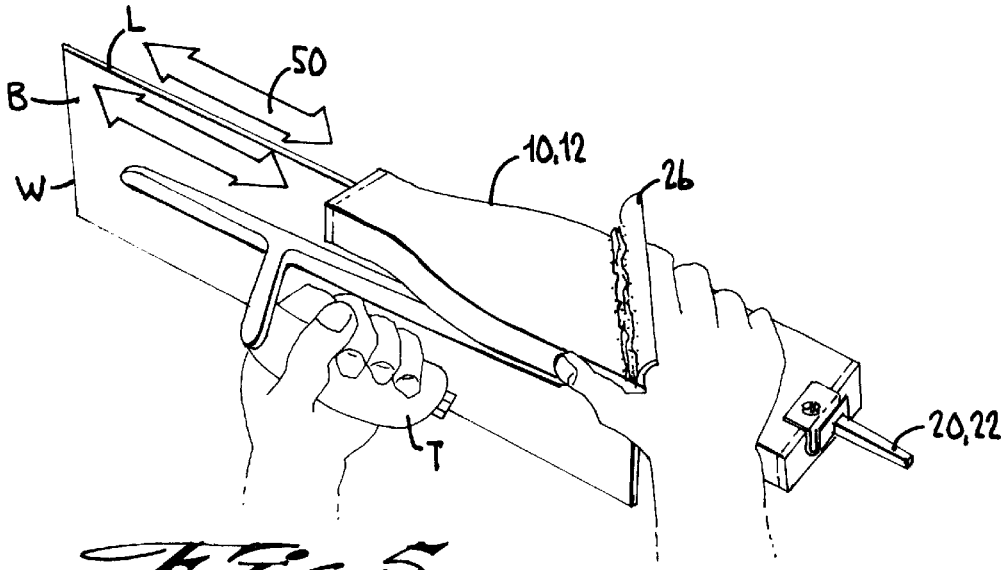
FIG. 5 is a perspective view illustrating use of the filing tool, e.g., as in use filing the edges of the trowel shown by FIG. 4.

The alternative way of holding the file has its own problems. If the file were held at an oblique angle relative to the sharp edge (not shown), then the file would be easier to balance, more stable, and more safely held. However, by the holding the file like that, experience teaches that a mason, against his or her wishes, gives the file too much pressure during the stroke in the mid-parts of the edge, and too little pressure at the forward and rearward ends. The long edge comes to be gently curved-in from between the front and rear ends. In use, however, masons do not want such a curved edge. They want the edge straight as possible down its length. What is needed by masons is an improvement in the filing of worn trowel edges to address the problems associated with holding a flat file in the bare hand As FIG. 5 shows, the filing tool 10 in accordance with the invention has its body 12 shaped and arranged to more handily give a mason a graspable profile in order to more stably dress the edge L of a worn trowel T. With his or her left hand, the mason can balance the trowel T as shown on top of a support surface (not shown) while, with the right hand, giving the filing tool 10 movement back and forth along arrows 50 relative to the stationary trowel T, wherein the mason pushes the tool 10 forwardly to file and pulls it (the tool 10) backwards in order to re-start another filing stroke.

The guide slot 36 (see FIGS. 2 and 3) is given a width that allows close-fitting removable insertion of the trowel's long edge L. The long edge L is insertable in the guide slot 36 until the long edge L limits out against the file 20's raspy surface (this arrangement of things is not shown). The mason then starts pushing the tool 10 to get a filing stroke, alternated by a return stroke, back and forth, with strokes sufficiently long to traverse the entire length of the long edge L.

Figure 6:
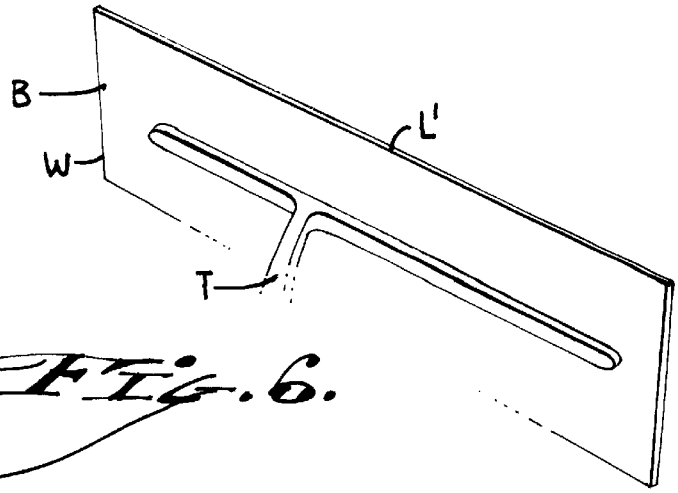
FIG. 6 is a view comparable to FIG. 4 except showing the results obtained by the operation shown in FIG. 5.

FIG. 5 shows that the mason's forefinger can rest against the forefinger guide 26. This allows the mason to give the long edge L a more forceful filing stroke in the direction of pushing. The tubular body 12 is given sufficient width to prevent the mason's finger tips from wrapping around the filing tool 10, in harm's way, in the area of the guide slot 36 (see FIG. 3). FIG. 6 shows the results obtained by use of the filing tool 10 if used in accordance with FIG. 5. The filing tool 10 gives the trowel T a substantially straight, substantially dulled long edge L', in a manner more safely than by holding the file in a bare hand. Additionally, this much desired result is more easily reproducible time after time than also is possible by holding the file in the bare hand.

Figure 7:
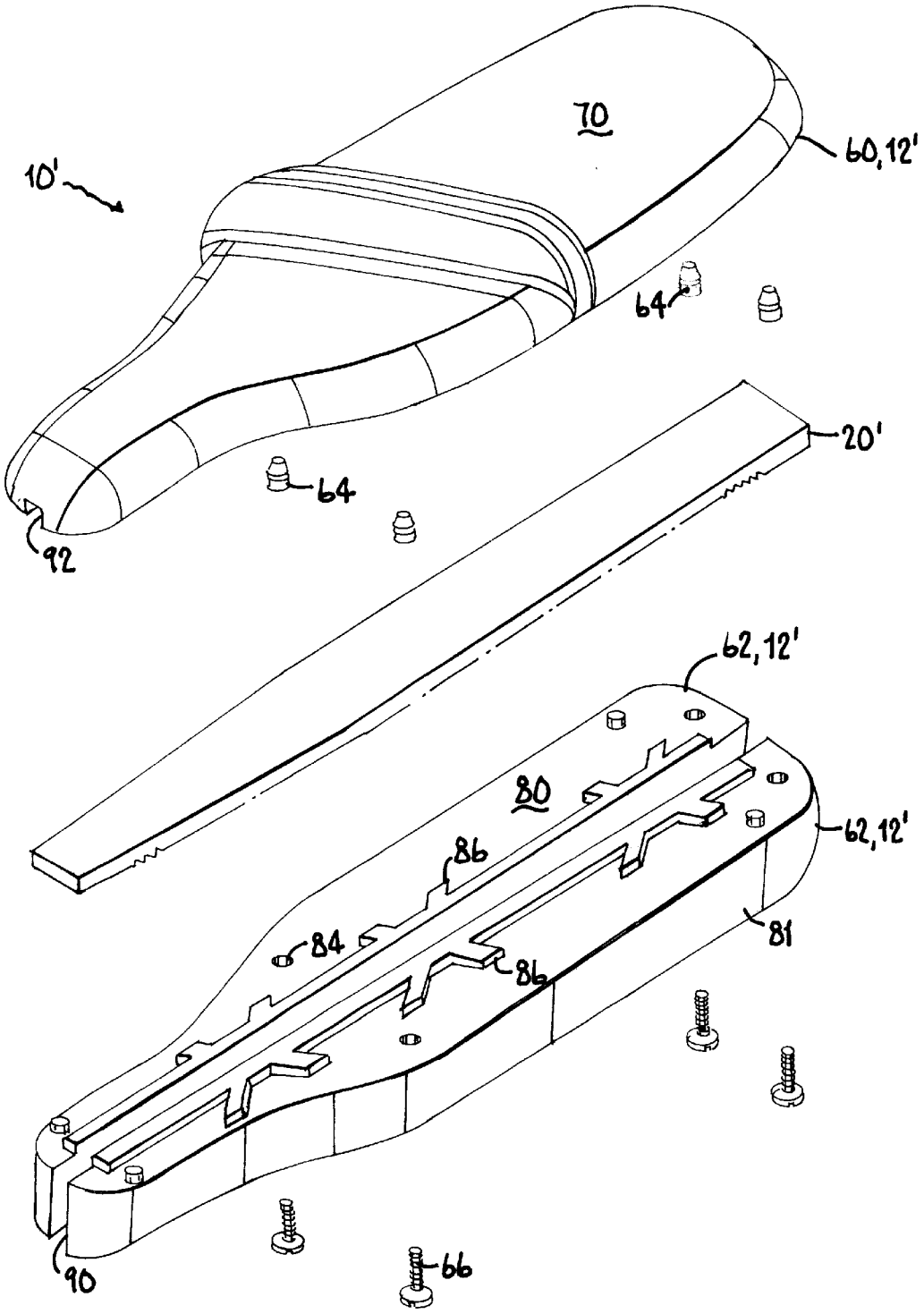
FIG. 7 is an exploded perspective view of an alternate embodiment of the filing tool in accordance with the invention.

FIGS. 7 through 12 show an alternate embodiment of the filing tool 10' in accordance with the invention. In FIG. 7, the file 20' is shown having a raspy or bastard-cut surface on only one face (i.e, the down face as the file is oriented in FIG. 7). However, this is a distinction with no real significance. It is preferred if the file 20' had two raspy surfaces to give the file 20' twice as long of an effective life. Nevertheless, the file 20' in the drawings is disclosed having one raspy surface, and it is depicted as a non-limiting example of what a file can look like in use in the invention.

The file 20' is clamped in place by assembly of a multi-component body 12'. The assembly components of the body 12 include an elongated web component 60 that assembles together with a combination of left and right flange components 62. These assembly components 60 and 62 are molded pieces of moldable polymer or resinous material. The use of moldable polymer or resinous material is preferred for economy as well as for ease in producing complex shapes as shown, in which there are many smooth curves to provide a comfortable hand grip and various internal recesses to form a file-clamping structure, as will be described further below.

FIG. 7 shows that the web component 60 receives steel threaded-inserts 64 for accepting screws 66 that fix the flange components 62 onto the web component 64. The steel inserts 64 allow the screws 66 to be tightened down to relatively high torques without stripping the internal thread in the inserts 64.

Figure 11:
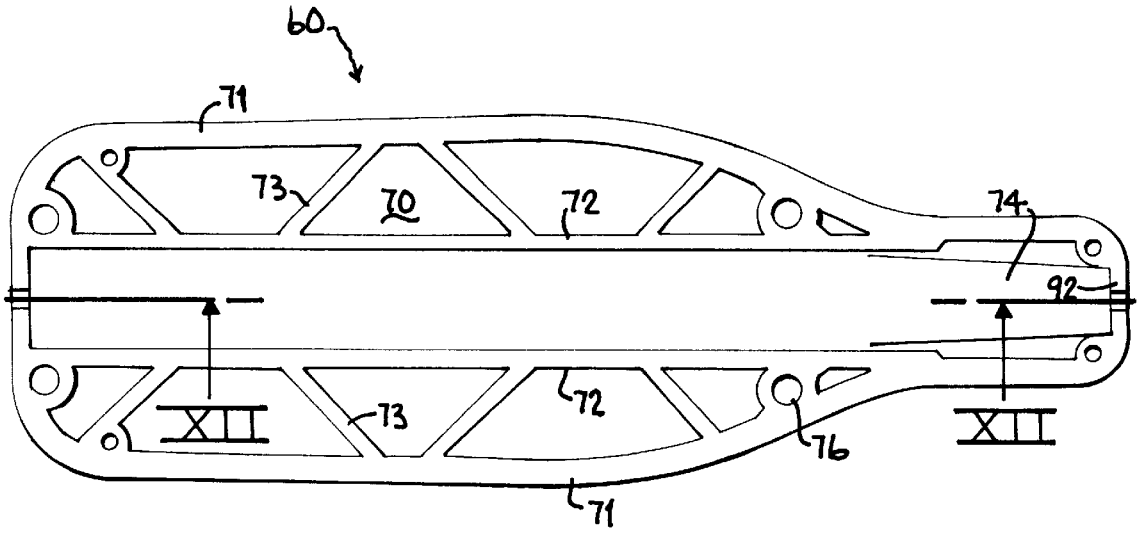
FIG. 11 is a bottom plan view of the cap piece of the filing tool of FIG. 7.
Figure 12:
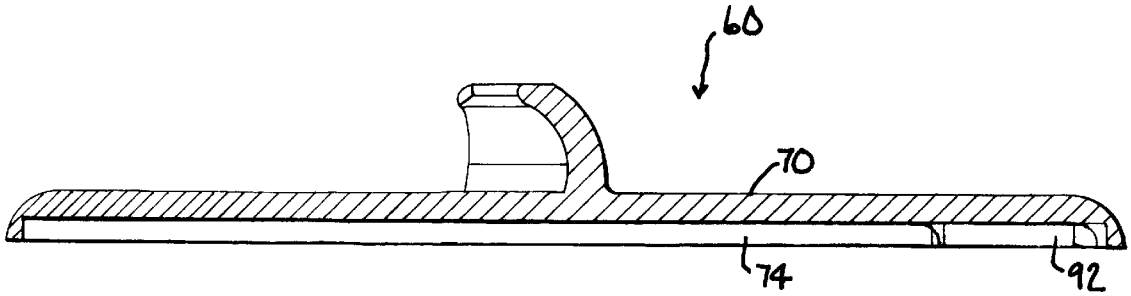
FIG. 12 is a sectional view taken along line XII—XII in FIG. 11.

FIG. 11 is a bottom plan view of the web component 60 in isolation. FIG. 12 is a sectional view through the web component 60 taken along line XII—XII in FIG. 11. With general reference to FIGS. 11 and 12, web component 60 comprises a top web portion 70 formed with an assortment of depending flange portions 71–73. These flange portions 71–73 include a peripheral portion 71 that follows around the whole outside periphery of the web component 60. These flange portions 71–73 further include an internal loop 72 that defines a cavity or pocket 74 in which the file 20' can rest. This internal pocket 74 is sized and shaped to closely surround the file 20' along all its side edges to restrain it from lateral and/or axial movement in the pocket. The flange portions 71–73 additionally include diagonal stiffener portions 73 to give the web component 60 overall better rigidity. The steel inserts 64 fit in sockets 76 that are provided at four spaced locations.

Figure 8:
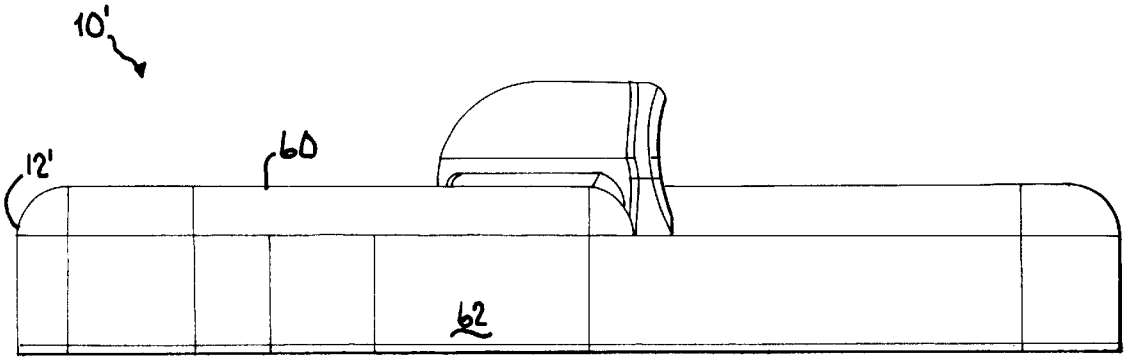
FIG. 8 is a side elevational view of the assembled filing tool of FIG. 7.
Figure 9:
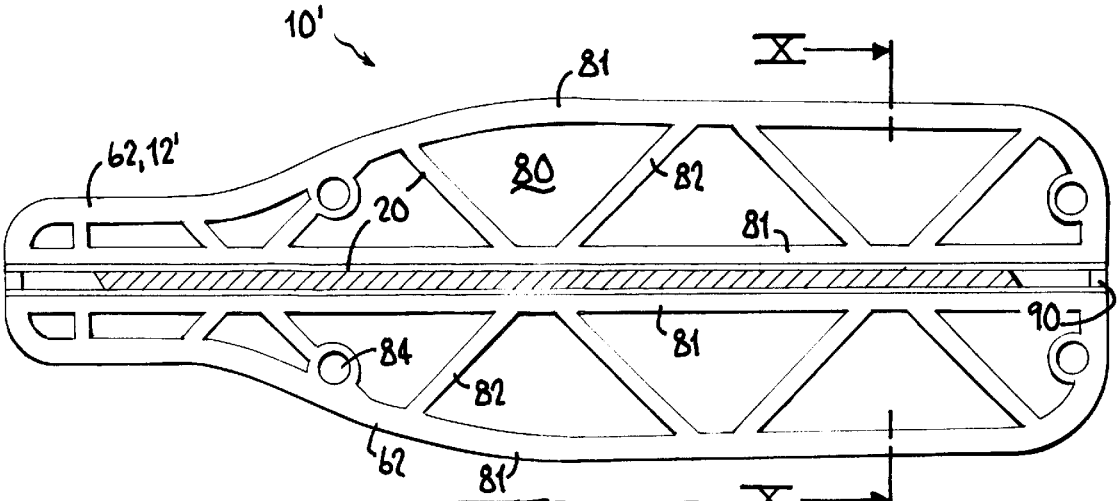
FIG. 9 is a bottom plan view FIG. 7.
Figure 10:
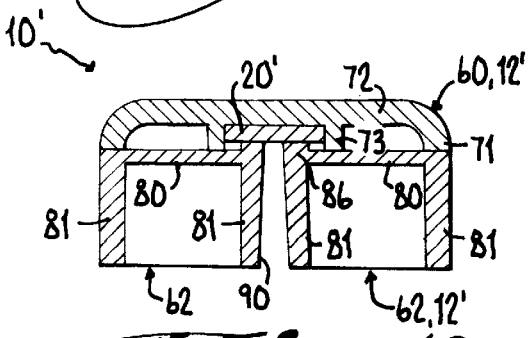
FIG. 10 is a sectional view taken along line X—X in FIG. 9.

FIGS. 8 through 10 show the completed assembly of the body 12' with file 20'. With general reference to FIGS. 9 and 10, the flange components 62 have a top web portion 80 formed with an assortment of depending flange portions 81–82. These flange portions 81–82 include a peripheral portion 81 that follows around the whole outside periphery of each flange component 62. The flange portions 81–82 additionally include diagonal stiffener portions 82 to improve the overall rigidity of the flange components 62. FIG. 9 shows that each flange component 62 includes two through holes 84 for insertions of the screws 66 (shown by FIG. 7).

FIGS. 7 and 19 show that each flange component 62 has upraised clamping abutments 86 protruding off the top of its web portion 80. FIG. 7 shows that the clamping abutments 86 are aligned to abut against the raspy surface of the file 20' along its opposite edge margins. FIG. 10 shows how, after assembly, the clamping abutments 86 align on the file 20'. The size and arrangement of the clamping abutments 86 with respect to the depth of the pocket 74 in the web component 60, are chosen such that tightening the screws 66 increases the clamping pressure or squeeze on the file 20' between the web and flange components 60 and 62 of the body assembly 12'.

Given the foregoing, this arrangement of assembly components 12' allows tight clamping to be achieved between the web and flange 60 and 62 components. The relative tightness of the clamping can be adjusted by tightening the screws 66. As FIG. 10 shows, the pocket 74 in the web component 60 closely surrounds the sides of the file 20' and abuts flush with the un-used or top (i.e., the reference direction "top" being relative to the view of FIG. 10) surface of the file 20'. The clamping abutments 86 on the flange components 62 contact the file 20' on the edge margins of its bottom, raspy surface and apply a clamping force on the file 20' which is opposed by the web component 60. FIG. 11 further shows that the pocket 74 is configured to limit fore to aft movement of the file 20' in the pocket 74. Accordingly, the embodiment of the filing tool 10' shown by FIGS. 7–12 achieves clamping the file 20' in place such that the file 20' is, for all practical purposes, immobile relative to the body 12'.

The left and right flange components 62 define the guide slot 90 for the FIG. 7 filing tool 10'. FIGS. 11 and 12 show that the upper extremity of the guide slot 90 is continued into the web component 60 in the form of opposite rectangular notches 92 in the peripheral flange portions 71 of the web component 60.

Comparison between FIGS. 2 and 10 show that the file 20/20' is directly backed on its upper surface by direct contact with the top wall 28 (in FIG. 2) or web portion 71 of the web component 60 (in FIG. 10). Test trials have shown that this location of the file 20/20' relative to the top wall 28 (FIG. 2) or web component 60's web portion 71 (FIG. 10), provides for a highly stable filing tool. U.S. Pat. No. Des. 310,162— DeJohn, shows a tool for filing a cement finishing trowel. The file in the DeJohn tool is located spaced substantially below the top wall of the tool (i.e., see FIG. 3 therein).

It has been found that, during a filing stroke, a user cannot but avoid slightly rolling the filing tool 10/10' clockwise and counterclockwise left and right about file's line of contact with the worn edge of the trowel. The inventor hereof prefers to locate the file 20/20' as shown in FIGS. 2 or 10, because the handling of the filing tool 10/10' during a stroke is inherently more stable. In practical terms, there is virtually no moment arm between bottom of the file 20/20' and the top of the tool 10/10'. Whereas the user may unintentionally apply a rolling force to tool 10/10' during a filing stroke, the applied torque will be minimal between the worn edge of the trowel L and guide slot 36 (refer to FIG. 5). There is less a problem of erosion of the guide slot where a misaligned trowel aligns—not properly on the file as at a right angle, but—at an off angle. The tool shown by U.S. Pat. No. Des. 3,310,162 discloses a substantial space between the top of the tool and the bottom of the file (e.g., the reference directions of top and bottom being taken from the orientation of FIG. 3 therein), but does not disclose or suggest the advantages of keeping the file 20/20' close to the top of the tool 10/10' for improved filing stability as does the invention disclosed and claimed herein.

Figure 13:
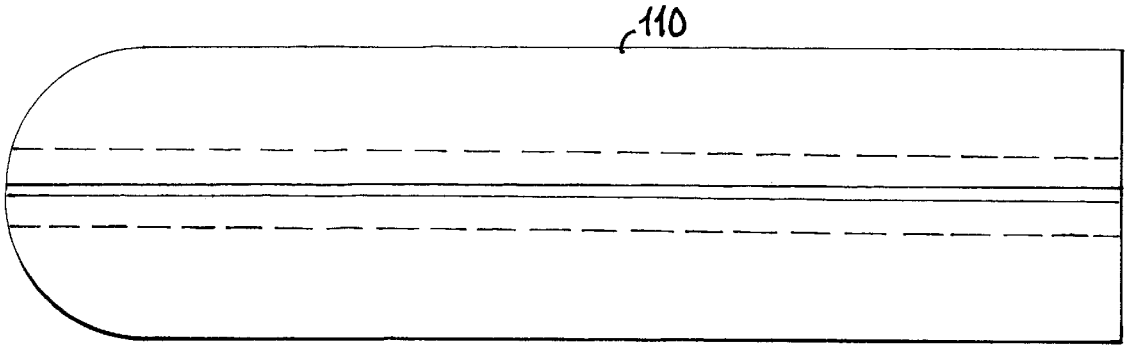
FIG. 13 is a bottom plan view of another embodiment of the filing tool in accordance the invention.
Figure 14:
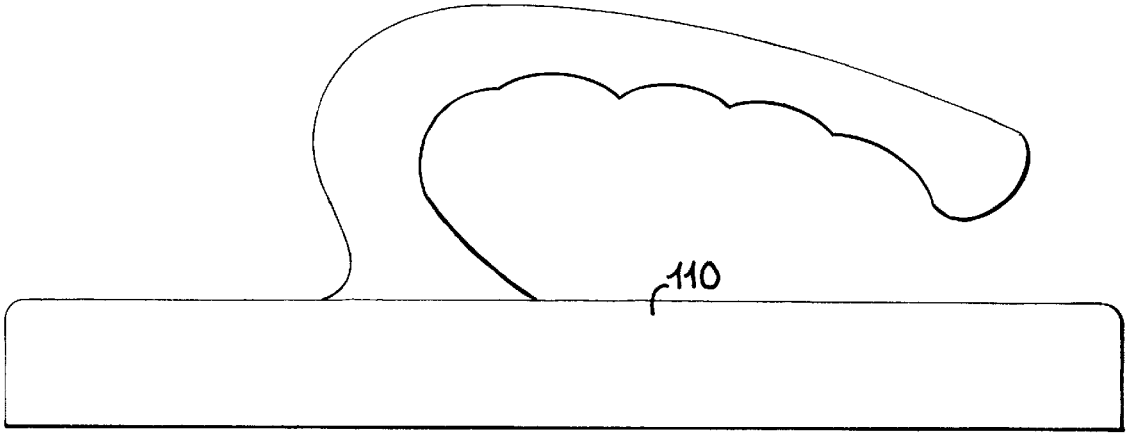
FIG. 14 is a side elevational view of FIG. 13.
Figure 15:
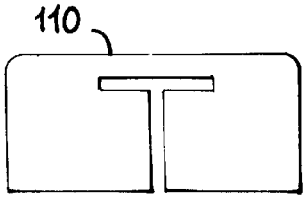
FIG. 15 is an end elevational view of FIG. 13.

FIGS. 13 through 15 show another embodiment 110 of a filing tool in accordance with the invention. This embodiment 110 is constructed more similarly to the FIG. 1 embodiment above than the FIG. 7 embodiment. Its inclusion here is to show that the handle portion of the filing tool can be given multiple forms, including as shown in FIG. 14.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A handtool for filing trowels, comprising:

a metal file having a filing surface; and, a body assembly in which the file is contained and clamped, the body assembly including a web component, left and right flange components and interconnecting fasteners;

wherein the web and flange components are shaped and arranged such that, when assembled together, the left and right flange components define a guide slot having generally parallel side walls, the left and right flange components being spaced apart such that the guide slot has a width adapted for allowing close fitting passage of a blade of a trowel;

wherein the web component is formed with a recess in which the file can rest, the recess being located such that the file's filing surface is partly accessible in the guide slot for filing on the trowel blade when passed through the guide slot;

wherein the left and right flange components include abutment surfaces arranged to abut the file's filing surface at spaced left and right locations in order to press upon the file while at rest in the recess in the web component, whereby tightening the fasteners effectively clamps the file more tightly between the web flange components; and, wherein the web component has a top wall formed with an upright bearing surface which, when the handtool is grasped for use with a user's palm rested substantially on the top wall, said bearing surface is arranged and shaped to bear against at least the side of the first and largest knuckle on the user's index finger, the bearing surface opposing hand slip during a forceful filing stroke in a direction of pushing as a safety precaution against the risk of the hand slipping off the towel-filing handtool and onto a sharp trowel blade.

2. The handtool of claim 1 wherein:

the web component has a top wall in which the recess is formed, the recess being shaped and arranged to extend into the web component such that distance between the top wall and the filing surface of file at rest in the recess is minimized in order to assist the handling stability of the handtool.

3. The handtool of claim 1 wherein:

the web and flange components are made from moldable materials including moldable polymer or resinous materials.

4. The handtool of claim 1 wherein:

the bearing surface comprises a substantially upright flange traversing the top wall at an oblique angle relative to the orientation of filing strokes in the direction of pushing, which said oblique angle accomodates either one of a left-handed or right-handed user.

5. The handtool of claim 4 wherein:

the oblique angle comprises about 45° relative to the direction of pushing.

6. The handtool of claim 4 wherein:

the upright flange is elongated such that it provides contact to the sides of at least two of the three knuckles of the index finger.

7. The handtool of claim 1 wherein:

the bearing surface comprises the concave surface a halved-cylinder traversing the top wall at an oblique angle relative to the orientation of filing strokes in the direction of pushing, which said oblique angle accomodates either one of a left-handed or right-handed user.

8. A handtool for filing worn edges of a trowel blade, comprising:

a metal file having a filing surface;

a body assembly, for containing the file, having an elongated web component and left and right elongated flange components interconnected to the web component to define a guide slot that is given generally parallel side walls as well as a generally open and accessible bottom, front and back; and, interconnecting means for forming a secure interconnection between the web and flange components;

one of (i) the web component, and (ii) the left and right flange components in combination, being formed with a recess in which the file can rest in a position such that the file's filing surface is partly accessible in the guide slot for filing on the trowel blade when passed through the guide slot;

the other of (i) the web component, and (ii) the left and right flange components in combination, being formed with abutment surfaces to abut the file while in the recess therefor, whereby securing the interconnecting means during assembly effectively creates and enhances a clamping arrangement on the file between the web and flange components;

wherein the web component has a top wall formed with an upright bearing surface which, when the handtool is grasped for use with a user's palm rested substantially on the top wall, said bearing surface is arranged and shaped to bear against at least the side of the first and largest knuckle on the user's index finger, the bearing surface opposing hand slip during a forceful filing stroke in a direction of pushing as a safety precaution against the risk of the hand slipping off the towel-filing handtool and onto a sharp trowel blade.

9. The handtool of claim 8 wherein:

the web and flange components are made from moldable materials including moldable polymer or resinous materials.

10. The handtool of claim 8 wherein:

the bearing surface comprises a substantially upright flange traversing the top wall at an oblique angle relative to the orientation of filing strokes in the direction of pushing, which said oblique angle accomodates either one of a left-handed or right-handed user.

11. The handtool of claim 10 wherein:

the oblique angle comprises about 45° relative to the direction of pushing.

12. The handtool of claim 10 wherein:

the upright flange is elongated such that it provides contact to the sides of at least two of the three knuckles of the index finger.

13. The handtool of claim 8 wherein:

the bearing surface comprises a concave surface, a sectioned-cylinder traversing the top wall at an oblique angle relative to the orientation of filing strokes in the direction of pushing, which oblique angle is comfortable to alternatively to one of a left-handed or right-handed user.

* * * * *